United States Patent [19]

Clerc et al.

[11] Patent Number: 4,563,609

[45] Date of Patent: Jan. 7, 1986

[54] DIRECTLY-HEATED CATHODES

[75] Inventors: Guy Clerc, Thonon; Pierre Gerlach; Roger Hoët, both of Thonon-les-Bains, all of France

[73] Assignee: Thomson-CSF, Paris, France

[21] Appl. No.: 524,234

[22] Filed: Aug. 18, 1983

[30] Foreign Application Priority Data

Aug. 31, 1982 [FR] France ..... 82 14894

[51] Int. Cl.[4] ..... A47B 88/00

[52] U.S. Cl. ..... 313/343; 313/20; 313/30; 313/33

[58] Field of Search ..... 313/20, 33, 30, 343

[56] References Cited

U.S. PATENT DOCUMENTS

| | | | |
|---|---|---|---|
| 2,431,767 | 12/1947 | Murdock et al. | 313/343 X |
| 2,615,137 | 10/1952 | Duke | 313/343 X |
| 2,882,436 | 4/1959 | Dorgelo | 313/343 X |
| 2,928,978 | 3/1960 | Morton | 313/343 |
| 3,152,276 | 10/1964 | Dorgelo | 313/30 |

*Primary Examiner*—Robert Lindsay

[57] ABSTRACT

A directly-heated cathode for power electron tubes such as triodes, tetrodes or pentodes comprises a cylindrical sleeve constituted by a lattice of crossed wires forming the emissive portion of the cathode and by two conductive plates attached respectively to each end of the sleeve. In order to permit free deformation of the cathode, a flexible metallic bellows element is fixed between one of the plates and the corresponding end of the cylindrical sleeve.

12 Claims, 7 Drawing Figures

DIRECTLY-HEATED CATHODES

The present invention relates to a directly-heated cathode, in particular a directly-heated cathode for power electron tubes such as triodes, tetrodes or pentodes.

The directly-heated cathodes employed in these types of electron tubes consist in most cases of a cylindrical sleeve formed of tungsten wires (which may or may not be of thoriated tungsten). These wires are wound in a helix and uniformly distributed in two layers inclined respectively in opposite directions with respect to a generator-line of the cylinder in order to form a lattice, the wires of the two layers being joined together at each intersection by means of a spot weld. The two ends of the cylindrical lattice forming the emissive portion of the cathode are attached respectively to two circular metal plates placed opposite to each other and connected to the external lead-in wires of the electron tube by means of rods of refractory metal. A potential difference is applied between said rods in order to establish and maintain the temperature of the cathode.

However, as a result of the particular structure of a cathode comprising on the one hand a lattice formed by wires of small cross-sectional area and on the other hand by small rods and circular plates constituted by much more massive parts, disadvantages are observed such as deformation of the cathode caused by the temperature differences existing between the lattice and the other components when voltage is applied to the cathode, and maintenance of such deformation after stabilization since the temperature of the lattice always remains higher than that of the parts which support the lattice. It has in fact been found that the cathode structure as well as the deformations caused by temperature variations arising from conditions of operation of the tube produce a modification in the electrical characteristics of the electron tube during operation.

A number of different solutions have been contemplated with a view to overcoming the disadvantages mentioned in the foregoing.

Thus in U.S. Pat. No. 3,824,424, it has been proposed to bend-back in the plane of the plate the upper end of the latticework sleeve of the cathode, the lengths of wire of the lattice being welded flat on said plate. This solution involves technological difficulties, however, and permits only slight freedom of movement of the cathode.

In French Pat. Appln. No. 81 21 805 in the name of the present Applicant, it has also been proposed to construct at least one of the plates in such a manner as to form, at the point of attachment of the plate to the end of the sleeve, an annular portion of reduced thickness which affords high resistance to the flow of heating current. By virtue of the flexibility given to the plate by said thinned annular portion, the cathode is provided with one degree of freedom along its axis and is thus permitted to absorb certain axial deformations. However, the possibility of deformation of the cathode remains limited.

In consequence, the aim of the present invention is to provide a remedy for the unsolved problems encountered in the prior art by proposing a design concept which permits substantial expansion of the latticework sleeve of the cathode while maintaining the geometrical dimensions which are essential for satisfactory electrical performance of the electron tube and while also ensuring that the latticework sleeve is continuously centered with respect to said electron tube axis.

This invention is therefore concerned with a directly-heated cathode for electron tubes comprising a cylindrical sleeve constituted by a lattice of crossed wires forming the emissive portion of the cathode and by two plates mounted respectively on the ends of said sleeve. The distinctive feature of the invention lies in the fact that the cathode comprises at least one flexible metallic element in the form of a bellows fixed between one of the plates and the corresponding end of the cylindrical sleeve.

The flexible metallic element in the form of a bellows can be constructed in different ways. In accordance with a first embodiment, the bellows element is constituted by an annular element, the inner edge of which is welded on the plate and the outer edge of which is welded on the corresponding end of the sleeve.

In another embodiment, the bellows element is constituted by two annular elements welded together along their inner peripheral edges and having a V-shaped crosssection. The outer peripheral edge of the plate and the corresponding end of the sleeve are welded respectively on the outer peripheral edges of the two annular elements.

In the two embodiments referred-to above, the surface of the annular elements can be flat or provided with concentric ribs. Furthermore, in order to improve the flexibility of the annular elements, these latter can be provided on their periphery with radial slits or other cut-out openings of similar type.

In a third embodiment, the bellows element is formed by a cylindrical element folded so as to form bellows-type pleats in its axial direction.

Other features of the invention will be more apparent upon consideration of the following description and accompanying drawings, wherein.

In the different figures of the accompanying drawings, the same reference numerals designate the same elements.

Figure 1:
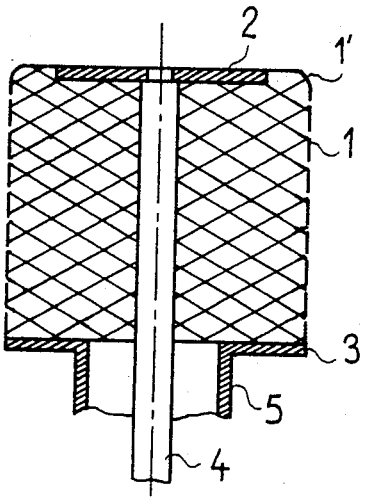
FIG 1 PRIOR ART
FIG. 1 is a schematic sectional view of a first form of construction of a cathode of the prior art.

Thus the reference numeral 1 designates the cylindrical sleeve which forms the emissive portion of the cathode. The sleeve 1 is constituted in known manner by a lattice of crossed wires of thoriated tungsten. The two ends of the sleeve 1 are attached respectively, in the manner described below, to two circular metal plates 2 and 3. The reference numerals 4 and 5 designate respectively a rod and a tube which serve to connect the cathode to the voltage supply while heating the cathode during operation.

In accordance with the form of construction of the prior art as shown in FIG. 1, the plate 2 has a diameter which is smaller than that of the plate 3. Furthermore, the end portion 1' of the cylindrical sleeve 1 is bent-back so as to be located in the same plane as the plate 2 and the lengths of wire of the lattice which forms the sleeve 1 are welded flat on said plate.

Figure 2:
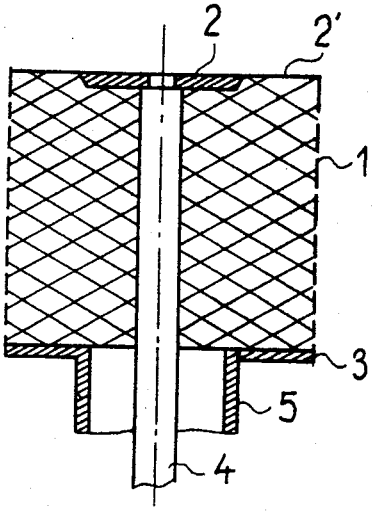
FIG 2 PRIOR ART
FIG. 2 is a schematic sectional view of a second form of construction of a cathode of the prior art.

In another form of construction of the prior art as illustrated in FIG. 2, the plate 2 is provided with an annular portion 2' of reduced thickness located at the level of the outer periphery of said plate and designed to receive the end portion of the sleeve 1. By means of said thinned portion 2', the plate 2 acquires flexibility which endows the cathode with one degree of freedom along its axis.

In the two forms of construction described in the foregoing, however, the possibilities of deformation of the cathode remain limited.

In accordance with the present invention, an elastically deformable metallic element 6 in the form of a bellows is consequently provided between at least one of the plates 2 or 3 and the corresponding end portion of the sleeve 1.

Figure 3:
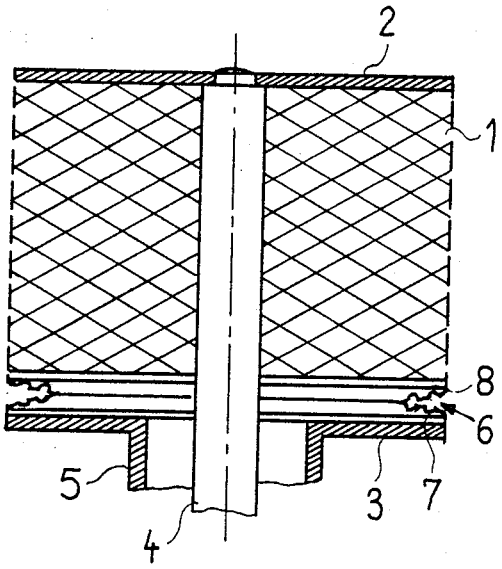
FIG. 3 is a schematic sectional view of one embodiment of a cathode in accordance with the present invention.
Figure 4:
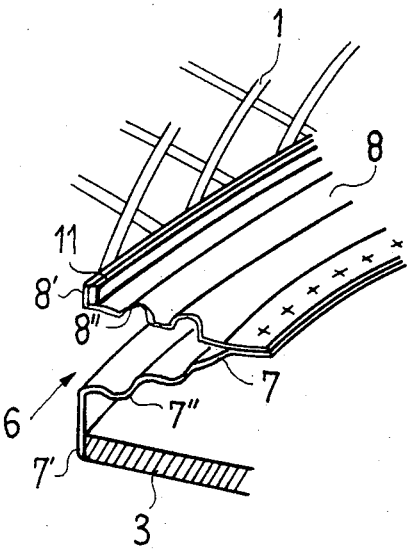
FIG. 4 is a view in perspective showing part of the cathode of FIG. 3.

As shown in FIGS. 3 and 4, the element 6 is made up of two annular elements 7 and 8. The two elements 7 and 8 are welded together along their inner periphery by spot welding or argon-arc welding and are flared-out towards the exterior in order to have a substantially V-shpaed cross-section. The elements 7 and 8 are flexible toward and away from each other axially of the sleeve 1. Moreover, the elements 7 and 8 are provided at the level of their outer peripheral edge with an annular flange 7' and 8' which is substantially perpendicular to the surface of each annular element, one of the plates 3 and the corresponding end of the sleeve 1 being welded respectively to said annular flanges. As shown in FIG. 4, the surfaces of the annular elements 7, 8 are provided respectively with ribs 7'', 8'' in order to increase the possibilities of elastic deformation of the metallic element 6. Furthermore, the annular elements 7 and 8 are formed of material such as tantalum and have a thickness which is chosen as a function of the dimension of the cathode, that is to say within the range of a few hundredths to a few tenths of a millimeter. In addition, a strengthening ring 11 can be provided against the annular flange 8' on which is welded one of the ends of the wire lattice sleeve 1. Thus, by virtue of its bellows shape, the metallic element 6 is capable of either expansion or compression as a function of the deformations of the cathode.

Figure 5:
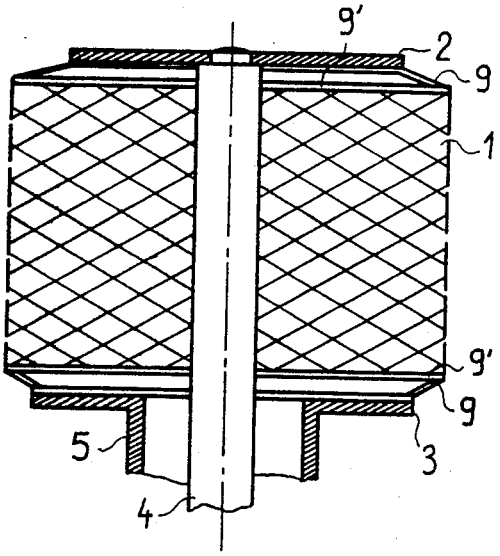
FIG. 5 is a schematic sectional view of another embodiment of a cathode in accordance with the present invention.
Figure 6:
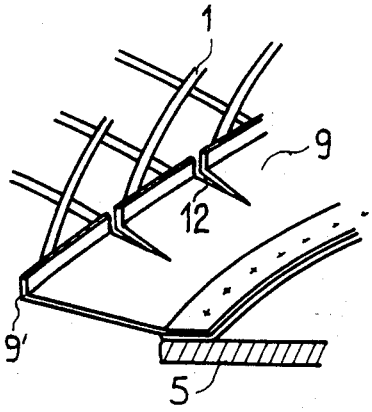
FIG. 6 is a view in perspective showing part of the cathode of FIG. 5.

In the embodiment shown in FIGS. 5 and 6, the metallic element 6 is constituted by a single annular element 9, the inner peripheral edge of which is welded on the plate 2 or 3. In this case the diameter of said plate is slightly larger than the internal diameter of the annular element. The element 9 has an annular flange 9' on which are welded the lengths of wire of the sleeve 1. In the embodiment shown in FIG. 5, an element 9 is provided between the plate 2 and the upper end of the sleeve 1 and an element 9 is provided between the plate 3 and the lower end of said sleeve 1. As a general rule, the plates 2 and 3 are formed of rigid material such as molybdenum. However, in the case of the embodiment of FIGS. 5 and 6, the plates 2 and 3 can be formed of flexible material.

Furthermore, the flexibility of the annular elements 7, 8 and 9 can be increased by making provision in said annular elements for radial slits 12 or other cutout openings of similar type as shown in FIG. 6. The slits extend from the outer edge of the annular element toward the inner edge thereof and terminate within that element.

Figure 7:
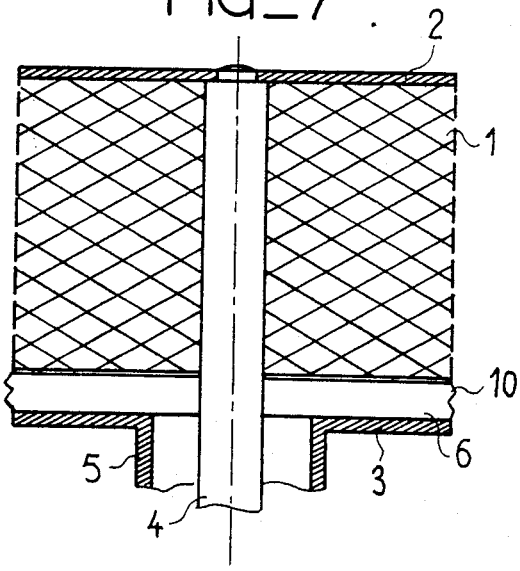
FIG. 7 is a schematic sectional view of a third embodiment of a cathode in accordance with the present invention.

In yet another embodiment shown in FIG. 7, the bellows element 6 can be formed by a cylindrical element 10 which is folded so as to form pleats in its axial direction. One end of the cylindrical element 10 is welded on the periphery of the plate 2 whilst the lengths of wire of the sleeve 1 are welded on the other end of the cylindrical element 10.

In the embodiments of FIGS. 3, 4 and 7, the cathode is provided with a single bellows element 6 mounted between the lower plate 3 and the corresponding end of the sleeve 1. However, it will be apparent to those versed in the art that the element 6 could be provided between the plate 2 and the upper end of the sleeve 1 or that two elements 6 could be employed as in the embodiment of FIGS. 5 and 6.

The bellows element 6 serves to absorb any deformations of the cathode in order to achieve the following results:

at the time of ignition of the cathode, free expansion of the lattice forming the sleeve 1 prior to a temperature rise of the internal rods 4;

at the time of extinction, contraction of the lattice without any attendant danger of tearing of welds at the level of the plates 2 and 3 prior to cooling of the rods;

during operation, adaptation of the length of the cathode as a function of the frequencies chosen and of the electric loads applied to the electron tube.

What is claimed is:

1. A directly heated cathode for electron tubes comprising:

a rod for connection to a voltage source;

a tube for connection to the voltage source;

a first electrically conductive plate connected to said rod;

a second electrically conductive plate connected to said tube whereby the voltage source establishes a potential difference between said plates;

a sleeve means for forming an emissive portion of the cathode, said sleeve means including a plurality of crossed wires which have thermal expansion coefficients different from the thermal expansion coefficients of said first and second plates;

first means electrically connecting the crossed wires of said sleeve means to said first plate; and bellows means electrically and movably connecting the crossed wires of said sleeve to said second plate, said bellows means including flexing means which permits the crossed wires to move with respect to said second plate to compensate for a difference in thermally induced deformation between the sleeve wires and said second plate, said flexing means including a pair of annular elements fixed together at an inner edge of each element, each element being shaped to diverge away from the other element to define a V-shape so the outer ends of said annular elements are spaced apart axially of said sleeve means, one of said element outer ends being fixed to said second plate and the other element outer end being fixed to the wires of said sleeve means, said diverging elements being flexible toward and away from each other axially of said sleeve means.

2. A directly heated cathode for electron tubes comprising:

a rod for connection to a voltage source;

a tube for connection to the voltage source;

a first electrically conductive plate connected to said rod;

a second electrically conductive plate connected to said tube whereby the voltage source establishes a potential difference between said plates;

a sleeve means for forming an emissive portion of the cathode, said sleeve means including a plurality of crossed wires which have thermal expansion coefficients different from the thermal expansion coefficients of said first and second plates;

first means electrically connecting the crossed wires of said sleeve means to said first plate; and bellows means electrically and movably connecting the crossed wires of said sleeve to said second plate, said bellows means including flexing means which permits the crossed wires to move with respect to said second plate to compensate for a difference in thermally induced deformation between the sleeve wires and said second plate, said flexing means including an annular plate having an inner edge fixed to said second plate and an outer edge fixed to the wires of said sleeve means and a plurality of slits in said annular plate extending from said outer edge toward said inner edge and terminating within said annular plate with at least some of said slits being located between adjacent wires.

3. The cathode defined in claim 1 further including a second bellows means connecting the sleeve wires to said first plate with said second bellows means operating independently of said first bellows means for isolating siad sleeve from said first and second plates.

4. The cathode defined in claim 1 further including a plurality of slits in said other annular element, said slits extending from said other element outer edge toward said other element inner edge.

5. The cathode defined in claim 3 further including a plurality of slits in said second bellows means.

6. The cathode defined in claim 2 further including a second bellows means connecting the sleeve wires to said first plate with said second bellows means operating independently of said first bellows means for isolating said sleeve from said first and second plates.

7. The cathode defined in claim 6 further including a plurality of slits in said second bellows means.

8. The cathode defined in claim 5 wherein said slits are V-shaped.

9. The cathode defined in claim 1 wherein each annular element outer edge includes a flange to which the sleeve wires are attached.

10. The cathode defined in claim 1 further including a plurality of rib means in each annular element.

11. The cathode defined in claim 7 wherein said slits are V-shaped.

12. A directly heated cathode for electron tubes comprising:

a rod for connection to a voltage source;

a tube for connection to the voltage source;

a first electrically conductive plate connected to said rod;

a second electrically conductive plate connected to said tube whereby the voltage source establishes a potential difference between said plates;

a sleeve means for forming an emissive portion of the cathode, said sleeve means including a plurality of crossed wires which have thermal expansion coefficients different from the thermal expansion coefficients of said first and second plates;

first means electrically connecting the crossed wires of said sleeve means to said first plate; and bellows means electrically and movably connecting the crossed wires of said sleeve to said second plate, said bellows means including flexing means which permits the crossed wires to move with respect to said second plate to compensate for a difference in thermally induced deformation between the sleeve wires and said second plate, said flexing means including a cylindrical body attached to said second plate and to the wires of said sleeve means, said cylindrical body being folded to form pleats which extend along the longitudinal centerline of said cylindrical body.

* * * * *